US005479771A

United States Patent [19]

Ballhausen et al.

[11] Patent Number: 5,479,771

[45] Date of Patent: Jan. 2, 1996

[54] METHOD AND DEVICE FOR MANUFACTURING A TWISTED YARN

[75] Inventors: Ulrich Ballhausen, Aachen; Gustav Franzen, Willich; Rainer Lorenz, Nettetal; Ulrich Lossa, Krefeld; Guido Spix, Kaarst, all of Germany

[73] Assignee: Palitex Project-Company GmbH, Krefeld, Germany

[21] Appl. No.: 310,695

[22] Filed: Sep. 16, 1994

[51] Int. Cl.[6] ..... D01H 4/08; D01H 4/38

[52] U.S. Cl. ..... 57/406; 57/409; 57/413

[58] Field of Search ..... 57/58.52, 58.7, 57/58.83, 400, 404, 406, 408, 409, 411, 413

[56] References Cited

FOREIGN PATENT DOCUMENTS

| | | |
|---|---|---|
| 2354403 | 1/1978 | France . |
| 78710 | 12/1970 | Germany . |
| 1785366 | 3/1972 | Germany . |
| 3721364 | 1/1989 | Germany . |
| 4023397 | 1/1992 | Germany . |

*Primary Examiner*—Joseph J. Hail, III

*Attorney, Agent, or Firm*—Robert W. Becker & Associates

[57] ABSTRACT

In a method and apparatus for manufacturing a yarn from fiber material at least two spinning devices arranged adjacent to one another are provided. Fiber material is dissolved and fed to the at least two spinning devices. Each spinning device generates an individual spun fiber. The individual spun fibers are combined at the inlet opening of a hollow spindle axis to form a yarn. The yarn undergoes a two-for-one twisting operation by being passed in a first yarn feeding direction through the hollow spindle axis to an outlet opening of the hollow spindle axis, then radially guided from the outlet opening, and guided in a second yarn feeding direction counter to the first yarn feeding direction to form a yarn balloon rotating in a direction of rotation about the at least two spinning devices. A centering element is arranged on an axis extending along the hollow spindle axle so as to be spaced from the inlet opening of the hollow spindle axle. The yarn is fed from the yarn balloon via the centering element to a winding device.

18 Claims, 3 Drawing Sheets

METHOD AND DEVICE FOR MANUFACTURING A TWISTED YARN

BACKGROUND OF THE INVENTION

The most conventional method for manufacturing a twisted yarn comprises in a first step the manufacture of spun fibers with a suitable spinning device, for example, rotary spinning devices, frictional spinning devices or annular spinning devices, from dissolved fiber material. In a subsequent method step the spun fibers are twisted in a twisting device, for example, a two-for-one twisting device to a twisted yarn. For the manufacture of a twisted yarn it is thus common to provide individual, separate spinning devices on the one hand and a twisting machine on the other hand. With respect to apparatus requirements as well as with respect to the operational sequence this conventional arrangement is very complicated.

The present invention relates to a new approach in which spinning devices are to be integrated into a twisting device operating substantially according to the two-for-one twisting method such that in a continuous operation the spun yarns which are produced by the spinning devices are directly thereafter combined to a yarn and then subjected to a two-for-one twisting operation in order to produce a twisted yarn.

An important element of the two-for-one twisting method is the yarn balloon in which the yarn rotates about the stationary spool pot of the twisting spindle to form an envelope that in the prior art has been considered to be impenetrable with respect to guiding therethrough material flows such as the fiber material in order to enter the space defined by the yarn balloon.

A first attempt to solve this problem of introducing material flows into the space defined by the yarn balloon is disclosed in German patent 37 21 364. In this known method a flow medium is introduced into the space delimited by the yarn balloon without any disturbance of the yarn balloon whereby the spindle rotor is provided with a plurality of spoke-like arranged guide vanes and the yarn guiding channel extends through one of these guide vanes. The flow medium to be introduced into the space defined by the yarn balloon is, in the case of a two-for-one twisting spindle, conditioned air or a two-phase medium such as droplets suspended in air which produce special effects on the yarn to. It is also disclosed in this publication that with this method fiber material can be introduced into the space defined by the yarn balloon.

It is an object of the present invention to provide a method for manufacturing a twisted yarn from at least two yarn components whereby dissolved fiber material is to be introduced to the twisting spindle and the finished twisted yarn is to be removed from the twisting spindle.

In German Offenlegungsschrift 1 785 366 published in 1972 a spinning method is disclosed which at the time was termed "element spinning" in which the fiber material is arranged in a fiber band which is then rotated to form a rotating balloon. For each revolution of the balloon at least two twists are imparted to the fiber band and the finished yarn is removed from the spindle. The device for performing this known spinning process comprises a spinning chamber which is arranged on a spindle. The fiber material is introduced into the spinning chamber via a fiber inlet tube that is arranged coaxial to the spindle axle and is radially guided through a channel extending through the spindle rotor. Within the spinning chamber a collector ring for the fiber material is provided and the fiber material is formed to a roving. The stretched fiber band is then guided through a channel arranged within the spindle axle where a first twist is imparted to the fiber band. The fiber band exits in the radial direction and enters a yarn balloon which rotates about the spinning chamber. Within the yarn balloon a second twist is imparted to the fiber band.

This principle is also discussed in German Publication 4 023 397 (1992) in which again a method for spinning of fibers to a yarn as well as a spinning device for performing the method is disclosed. The fiber material is introduced into the spinning rotor and the removed yarn exiting from the removal opening is guided coaxially about the spinning rotor in a counter rotational direction in an arc. In the device for performing this known spinning method the spinning rotor is supported in a double twisting rotor which itself is rotatably supported in a stationary housing. The yarn removed from the spinning rotor is guided through a removal channel arranged within the double twisting rotor and extending in an arc about the spinning rotor to the common axis of the spinning rotor and the double twisting rotor and is guided upwardly through the drive device of the double twisting rotor. Along this path the yarn is provided with a second twist. The fiber material is fed to the spinning rotor with a feed channel arranged within the double twisting rotor whereby the inlet opening of the feed channel is symmetric and the outlet opening of the feed channel is eccentric to the axis of the double twisting rotor.

A method for manufacturing a twisted yarn from at least two yarn components in which dissolved fiber material is fed to the twisting spindle and the finished, twisted yarn is removed from the spindle is not known in the prior art.

SUMMARY OF THE INVENTION

A method for manufacturing a yarn from fiber material according to the present invention is characterized by the following steps:

Providing at least two spinning devices arranged adjacent to one another;

Dissolving fiber material and feeding the dissolving fiber material to the at least spinning devices;

Generating with each spinning device an individual spun fiber;

Combining the individual spun fibers at an inlet opening of a hollow spindle axle to a yarn;

Twisting the yarn in a two-for-one twisting operation by passing the yarn in a first yarn feeding direction through the hollow spindle axle to an outlet opening of the hollow spindle axle, guiding the yarn substantially radially from the outlet opening of the hollow spindle axle; and then guiding the yarn in a second yarn feeding direction counter to the first yarn feeding direction, wherein the yarn forms a yarn balloon rotating in a direction of rotation about the at least two spinning devices;

Arranging a centering element on an axis extending along the hollow spindle axle so as to be spaced from the inlet opening of the hollow spindle axle; and Feeding the yarn from the yarn balloon via the centering element to a winding device.

Preferably, the at least two spinning devices are rotary spinning devices whereby the method further comprises the step of rotating the rotary spinning devices in a same rotational direction.

Preferably, the method further comprises the step of rotating the rotary spinning devices counter to the direction of rotation of the yarn balloon. In another embodiment of the present invention the method further comprises the step of rotating the rotary spinning device in the direction of rotation of the yarn balloon.

In yet another embodiment of the present invention, the at least two spinning devices are rotary spinning devices and the method further comprises the step of rotating the rotary spinning devices in opposite rotational directions.

Expediently, the step of feeding the dissolved fiber material includes the step of supplying laterally and/or radially the dissolved fiber material to the at least two spinning devices.

Advantageously, the method further comprises the steps of providing a yarn guide rotatable with the yarn balloon in an area of feeding the fiber material through the yarn balloon to the at least two spinning devices and guiding the yarn through the yarn guide.

In a preferred embodiment of the present invention, the method further comprises the step of supporting the yarn within the yarn balloon with a balloon limiter rotating with the yarn balloon.

Advantageously, the method further comprises the step of passing within the area of the yarn balloon the yarn through a yarn guide tube rotating with the hollow spindle axle.

Preferably, the step of feeding the dissolved fiber material includes the step of applying a negative pressure gradient in the feeding direction. Advantageously, the step of feeding the dissolved fiber material includes the steps of providing a suction tube in the form of a hollow shaft extending in the area of the hollow spindle axle and generating with the suction tube a vacuum within the at least two spinning devices.

The present invention further relates to a device for performing the inventive method. According to the present invention the device is primarily characterized by:

At least one drivable spindle rotor rotatably supported on a spindle rail;

A hollow spindle axle with an inlet opening and an outlet opening;

A yarn guide channel connected to the outlet opening so as to extend substantially radially outwardly, the yarn guide channel guiding a yarn exiting from the outlet opening of the hollow spindle axle radially outwardly for forming a yarn balloon;

A centering element arranged on an axis extending along the hollow spindle axle so as to be spaced from the inlet opening of the hollow spindle axle;

A yarn winding device positioned downstream of the centering element, wherein the yarn is guided from the yarn balloon via the centering element to the yarn winding device;

A means for feeding dissolved fiber material into the space defined by the yarn balloon;

At least two spinning devices positioned within the space defined by the yarn balloon;

Each one of the at least two spinning devices having an inlet tube with a receiving opening for receiving the dissolved fiber material;

The means for feeding having a feed tube with a mouth for each one of the at least two spinning devices, the feed tubes positioned outside of the space delimited by the yarn balloon such that the mouths are positioned opposite the receiving openings of the inlet tubes;

Each one of the at least two spinning devices having a fiber removal tube arranged such that the fibers generated by the at least two spinning devices are guided centrally into the hollow spindle axle; and A yarn guiding member, for guiding the yarn exiting from the yarn guide channel, fixedly connected to the spindle rotor.

Preferably, the yarn guiding member comprises a yarn guide extending into a gap formed between the mouths of the feed tubes and the receiving openings of the inlet tubes.

In a preferred embodiment of the present invention, the spindle rotor comprises a hollow shaft with a first and a second end, the first end connected to a vacuum line, the device further comprising a substantially closed chamber supported on the hollow shaft and secured against rotation, the at least two spinning devices having a common drive mechanism and the chamber enclosing the at least two spinning devices with their drive mechanism, the chamber having a wall section through which the inlet tubes are guided, the chamber further comprising vacuum channels, connected to the second end of the hollow shaft positioned in the chamber and arranged such that via the vacuum line a negative pressure gradient is created in the inlet tubes in a direction of feeding of the dissolved fiber material so as to effect feeding of the dissolved fiber material.

Advantageously, the chamber comprises a detachable lid.

Preferably, the device further comprises a stationary, substantially closed housing enclosing the chamber, wherein the centering element is provided at a top side of the housing and is in the form of an opening coaxially arranged relative to the hollow spindle axle, and wherein the housing has a sidewall and the mouths of the feed tubes are arranged in the sidewall. Preferably, the housing has a detachable cover.

The invention is based on the following features: the fiber material introduced into the twisting spindle through the rotating yarn balloon is directly used for the manufacture of the twisted yarn made of at least two spun fibers; the fiber material is guided such that it does not disturb the yarn balloon; and enough space is provided to arranged within the space defined by the yarn balloon a plurality of spinning devices to which the fiber material is fed in separate streams while the spun fibers removed from the spinning devices are guided together through the hollow spindle axle and into the yarn balloon. In comparison to conventional two-for-one twisting machines the space which is conventionally occupied by the required feed spools can be used according to the present invention by the spinning devices and their drive mechanism.

The spinning and twisting operation of the inventive open end spinning and twisting method is as follows.

Dissolved fiber material is guided through the yarn balloon into the interior of the spindle preferably shortly above or in the upper area of the yarn guiding member i.e., the balloon limiter or yarn guide tube, rotating together with the yarn balloon. At the location where the fiber stream penetrates the yarn balloon the yarn is preferably guided by a yarn guide that rotates with the yarn guiding element. Each spinning device, for example, a spinning rotor, is supplied with an individual fiber stream. The spinning rotors are driven by an electric motor counter to the rotational direction of the spindle rotor of the two-for-one twisting spindle. From each spinning rotor a spun yarn is removed in the upward direction and is guided to the center of the spindle, i.e., into the hollow spindle axle of the two-for-one twisting machine. At the point where the two spun yarns are combined, the doubled yarn is formed. Downstream of this location the first twisting zone of the two-for-one twisting spindle is arranged. The yarn is subsequently guided via the conventional yarn guide channel radially outwardly and is deflected upwardly by the yarn guiding member (for example, balloon limiter) rotating with the spindle rotor whereby it is guided in the area of the fiber material inlet, respectively, fiber material introduction, through the rotating yarn guide before it is passed through the centering element positioned on an axis forming an extension of the hollow spindle axle. This centering element, for example, is in the form of a yarn guide eye.

Above this yarn guide eye a positively driven and stationary removal device is provided downstream of which a conventional yarn winding device is positioned. Between the removal device and the winding device a conventional yarn length compensator is provided which provides a certain yarn storage function.

The feeding, respectively, introduction of the dissolved fiber material to the spinning devices is preferably performed with vacuum which in the area of the spinning devices is generated with a suction tube positioned in the area of the spindle axle that at its outer end is connected to a vacuum source. The inner end of the suction tube is connected to vacuum channels that are guided such that they generate within the fiber inlet tubes of the spinning devices a negative pressure gradient acting in the direction of fiber feed such that the fiber material introduction is effected by vacuum.

Separate drives for the spinning rotors and the two-for-one twisting spindle, allow for an adjustment of any desired ratio between spinning rotation and twisting rotation.

BRIEF DESCRIPTION OF THE DRAWINGS

The object and advantages of the present invention will appear more clearly from the following specification in conjunction with the accompany drawings, in which.

DESCRIPTION OF PREFERRED EMBODIMENTS

The present invention will now be described in detail with the aid of several specific embodiments utilizing FIGS. 1 through 3.

Figure 1:
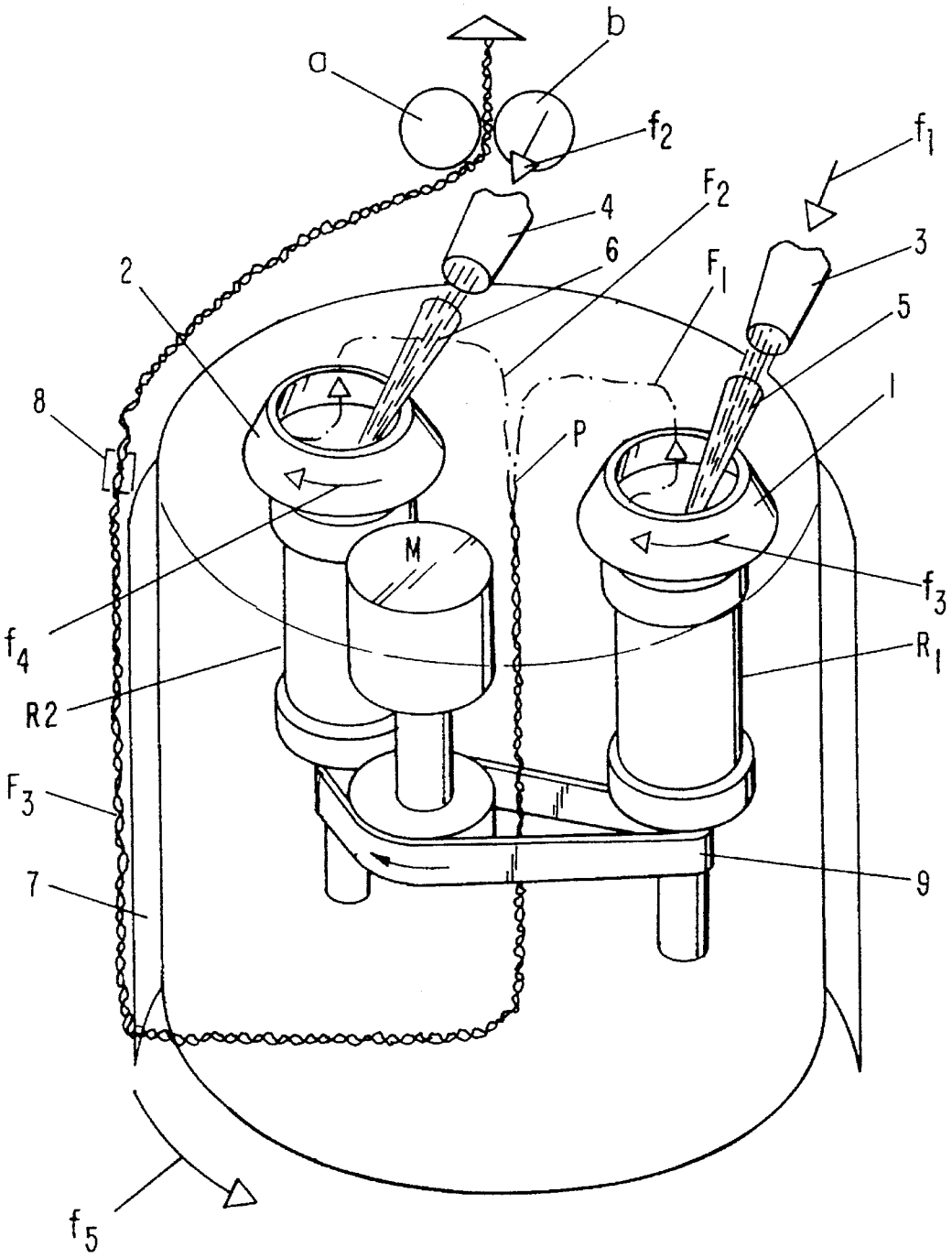
FIG. 1 shows a schematic representation of the operational steps of the inventive open end spinning and twisting method within the space defined by the yarn balloon of a two-for-one twisting machine.

The schematic representation of FIG. 1 shows two directly adjacently arranged rotor spinning devices R1 and R2 which are driven by a common motor M. The spinning devices R1, R2 are supplied with dissolved fiber material in the direction of arrows f1 and f2 via fiber material feed tubes 3 and 4. The fiber material is directly guided into the receiving opening of tubes 5 and 6 that open into the spinning rotors 1 and 2. The spun fibers F1 and F2 which are generated within the spinning rotors 1 and 2 according to the conventional open-end spinning method are removed upwardly from the spinning rotors 1 and 2, which are open at the top, and are guided to the point P where they are combined to a yarn. Point P is the starting point of forming the twisted yarn F3 according to the two-for-one twisting method whereby in a conventional manner the spun fibers are axially guided through the schematically represented two-for-one twisting spindle, represented only by the balloon limiter 7, along the spindle axle and after exiting from the radially extending yarn guide channel are guided under formation of the yarn balloon to the centering element which is positioned on an axis as an extension of the hollow spindle axle and which is defined by the two roller bodies a and b and from where the yarn is guided in a conventional manner to a yarn winding device. The spinning rotors 1 and 2 rotate in the same direction of rotation, as indicated by arrows f3 and f4 in FIG. 1, and the spindle rotor of the two-for-one twisting spindle rotates in the direction of arrow f5 counter to the rotational direction of the two spinning rotors.

Since the fiber material must be fed through the rotating yarn balloon, the twisted yarn, respectively, the yarn F3 is guided through a yarn guide 8 positioned at the upper end of the balloon limiter 7 which extends into the gap between the exterior feed tubes 3, 4 and the fiber material inlet tubes 5, 6 opening into the spinning rotors.

The two spinning rotors 1 and 2 of the rotor spinning devices R1 and R2 are driven by the motor M with a drive belt 9.

Figure 2:
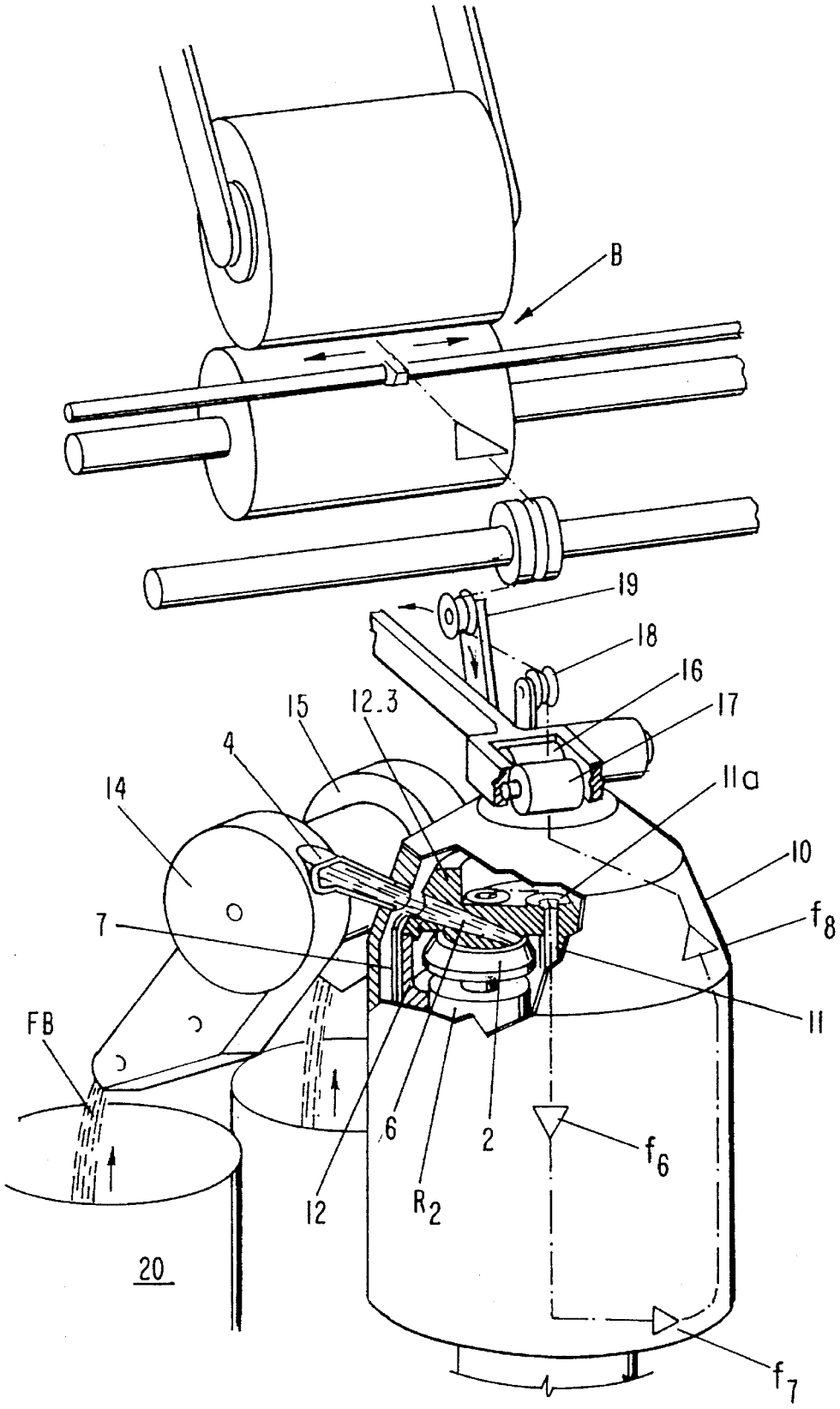
FIG. 2 shows partially in section a perspective view of a two-for-one twisting machine with a fiber dissolving device arranged upstream and a yarn winding device arranged downstream thereof.

FIG. 2 shows an outer housing 10 that encloses the two-for-one twisting spindle which is essentially represented by the balloon limiter 7, the upper inlet opening 11*a* of the hollow spindle axle 11 and by the schematically represented thread paths indicated by arrows f6, f7, and f8. Within the space limited by the balloon limiter 7 the chamber 12 is arranged in which one (R2) of the two rotor spinning devices represented in FIG. 1 is positioned. The fiber material inlet tube 6 opens into the spinning rotor 2 whereby the fiber material receiving opening is positioned within the lid 12.3 of the chamber 12. Opposite this receiving opening the mouth of the fiber material feed tube 4 guided through the exterior housing 10 is positioned at a distance. The feed tube 4 is part of the fiber material dissolving device 14 to which a fiber band FB is guided from a can 20. The rotor spinning device R1 not represented in FIG. 2 is provided with an identical fiber dissolving device 15. The cam or cams 20 and the dissolving devices 14, 15 represent the means for feeding dissolved fiber material.

The two spun fibers removed upwardly from the spinning rotors 1 and 2 are combined in the area of the upper inlet opening 11a of the hollow spindle axle 11, they are then passed downwardly through the hollow spindle axle in the direction of f6, are subsequently radially outwardly removed in the direction of arrow f7 before being removed in the upward direction (arrow f8) along the inner surface of the balloon limiter 7. Subsequently, they are guided through a yarn outlet, opening, provided at the top side of the exterior housing 10 and extending coaxially to the hollow spindle axle, to a conveying device 16, 17. Downstream of this feeding device 16, 17 the finished twisted yarn is guided via two guide pulleys 18, 19, at least one of which is pivotable against a spring force in order to provide for a length compensation, to a conventional reciprocating yarn winding device B.

Figure 3:
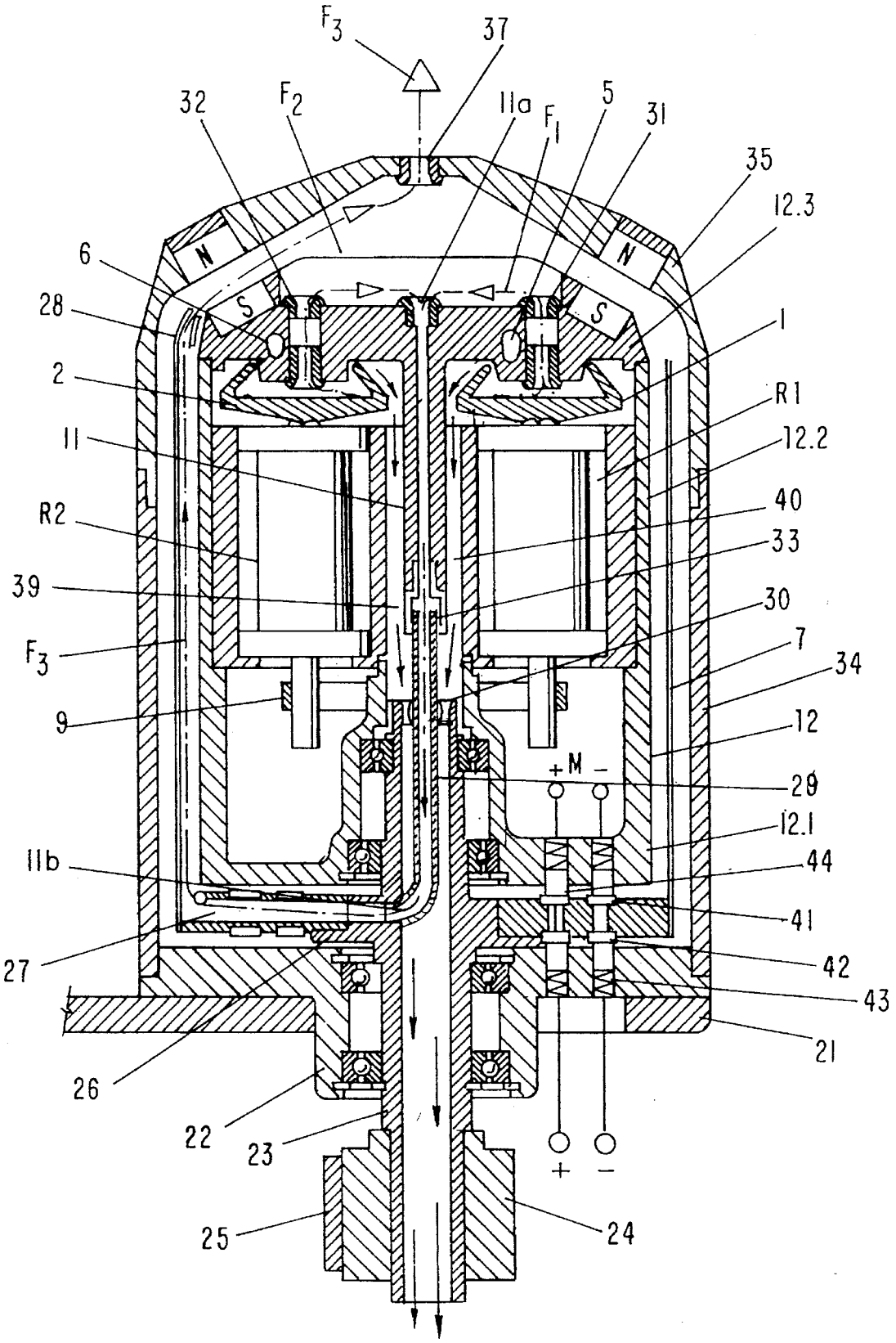
FIG. 3 shows in section a two-for-one twisting spindle with integrated spinning devices in the form of spinning rotors.

FIG. 3 shows a machine frame schematically represented by a spindle rail 21 on which a hollow shaft 23 is rotatably supported with a bearing block 22. The lower end of the hollow shaft 23 is connected to a non-represented vacuum source. The hollow shaft 23 which forms a part of the spindle rotor supports a radially oriented spindle rotor disk 26 with a yarn guide channel 27 which extends in the radial direction. The hollow shaft 23 is driven via the whorl 24 and a tangential drive belt 25. To the outer circumference of the spindle rotor disk 26 a balloon limiter 7 is connected which serves as a yarn guiding member for the yarn F3. At the upper end of the balloon limiter 7 a yarn guide 28 is provided. The yarn guide tube 29 opens into the inner end of the guide channel 27 and forms a part of the hollow spindle axle. The lower end 11b of the yarn guide tube 29 is bent and is inserted into the hollow shaft 23 such that between the hollow shaft and the yarn guide tube 29 vacuum channels 30 remain. The spindle rotor is thus essentially formed by the following elements: hollow shaft 23, spindle rotor disk 26, balloon limiter 7, yarn guide 28, and yarn guide tube 29.

At the upper end of the hollow shaft 23 a chamber 12 is supported via interposed suitable bearings. The chamber 12 is substantially a closed chamber that is secured against rotation. The chamber 12 is preferably in the form of a cylinder and has a bottom 12.1, a sidewall 12.2 and a detachable lid 12.3. Within this chamber 12 the two rotor spinning devices R1 and R2 are accommodated. Their spinning rotors 1 and 2 are driven with the drive belt 9 by the motor M not represented in FIG. 3. The fiber material inlet tubes 5 and 6 extend through the lid 12.3 and open into the spinning rotors 1 and 2. Spun fiber removal tubes 31 and 32 are also guided through the lid 12.3 and extend coaxially above the axis of the spinning rotors. The spun fibers F1 and F2 produced by the spinning rotors 1 and 2 are removed via these yarn removal tubes 31 and 32 to be introduced through the upper inlet opening 11*a* of the downwardly extending hollow spindle axle 11. The axle 11 opens into the upper end of the yarn guiding tube 29. A gap seal 33 is positioned between the free ends of the axle 11 and the tube 29.

The inner end of the hollow shaft 23 is connected to the vacuum channels 39, 40 which open into the interior of the chamber 12 in the area of the spinning rotors 1 and 2. The outer end of the hollow shaft 23 is connected in a non-represented manner to a vacuum source so that via the hollow shaft 23 and the vacuum channels 39, 40 a vacuum can be produced within the interior of the chamber 12. The vacuum acts on the fiber material inlet tubes 5 and 6 and effects the fiber feed into the spinning rotors 1 and 2.

The spinning and twisting device described in connection with FIG. 3 is enclosed by an exterior housing 34 that is provided with a detachable cover 35 having, for example, securing magnets M that cooperate with counter magnets S provided at the lid 12.3 of the chamber 12 so that the chamber 12 and thus the rotor spinning devices R1 and R2 are secured against rotation about the spindle axle in a contact-free manner. At the upper side of the housing 34 that is closed off by the cover 35 the centering element in the form of a yarn outlet opening 37 is provided and positioned coaxial to the axis of the hollow spindle axle 11. Downstream of the centering element 37 the conveying device 16, 17 (represented in FIG. 2) for the twisted yarn f3 is provided. The motor M is provided with power through the spindle rotor disk 26 via a slip ring contact system 41, 42, 43, 44 (schematically represented in FIG. 3) and corresponding electrical contacts. It is also possible to use a dynamometric energy conversion for generating and supplying the required electrical energy.

The operation of the inventive spinning and twisting device represented especially in FIG. 3 results substantially from the description provided in connection with FIGS. 1 and 2 so that a further discussion is not necessary.

The yarn guiding member which in FIGS. 2 and 3 is represented in the form of a balloon limiter 7 can also be in the form of a yarn guide tube connected to the yarn guiding channel 27 and optionally extending to the upper centering element, i.e., the yarn outlet opening 37, whereby the yarn guide 28 represented in FIG. 3 represents a part of this yarn guide member. The yarn guide tube, however, can also end at the location of the yarn guide 28 whereby then the upper end of this yarn guide tube takes over the function of the otherwise provided yarn guide 28.

The present invention is, of course, in no way restricted to the specific disclosure of the specification and drawings, but also encompasses any modifications within the scope of the appended claims.

What we claim is:

1. A method for manufacturing a yarn from fiber material, said method comprising the steps of:

providing at least two spinning devices arranged adjacent to one another;

dissolving fiber material and feeding the dissolved fiber material to said at least two spinning devices;

generating with each said spinning device an individual spun fiber;

combining said individual spun fibers at an inlet opening of a hollow spindle axle to a yarn;

twisting said yarn in a two-for-one twisting operation by first passing said yarn in a first yarn feeding direction through said hollow spindle axle to an outlet opening of said hollow spindle axle, guiding said yarn substantially radially from said outlet opening of said hollow spindle axle, and then guiding said yarn in a second yarn feeding direction counter to said first yarn feeding direction, wherein said yarn forms a yarn balloon rotating in a direction of rotation about said at least two spinning devices;

arranging a centering element on an axis extending along said hollow spindle axle so as to be spaced from said inlet opening of said hollow spindle axle; and feeding said yarn from said yarn balloon via said centering element to a winding device.

2. A method according to claim 1, wherein said at least two spinning devices are rotary spinning devices, further comprising the step of rotating said rotary spinning devices in a same rotational direction.

3. A method according to claim 2, further comprising the step of rotating said rotary spinning device counter to said direction of rotation of said yarn balloon.

4. A method according to claim 2, further comprising the step of rotating said rotary spinning device in said direction of rotation of said yarn balloon.

5. A method according to claim 1, wherein said at least two spinning devices are rotary spinning devices, further comprising the step of rotating said rotary spinning devices in opposite rotational directions.

6. A method according to claim 1, wherein said step of feeding said dissolved fiber material includes the step of supplying laterally said dissolved fiber material to said at least two spinning devices.

7. A method according to claim 1, wherein said step of feeding said dissolved fiber material includes the step of supplying radially said dissolved fiber material to said at least two spinning devices.

8. A method according to claim 1, further comprising the steps of:

providing a yarn guide rotatable with said yarn balloon in an area of feeding said fiber material through said yarn balloon to said at least two spinning devices; and guiding said yarn through said yarn guide.

9. A method according to claim 1, further comprising the step of supporting said yarn within said yarn balloon with a balloon limiter rotating with said yarn balloon.

10. A method according to claim 1, further comprising the step of passing within the area of said yarn balloon said yarn through a yarn guide tube rotating with said hollow spindle axle.

11. A method according to claim 1, wherein said step of feeding said dissolved fiber material includes the step of applying a negative pressure gradient in the feeding direction.

12. A method according to claim 11, wherein said step of feeding said dissolved fiber material includes the steps of providing a suction tube in the form of a hollow shaft extending in the area of said hollow spindle axle and generating with said suction tube a vacuum within said at least two spinning devices.

13. A device for manufacturing a yarn, said device comprising:

at least one drivable spindle rotor rotatably supported on a spindle rail;

a hollow spindle axle with an inlet opening and an outlet opening;

a yarn guide channel connected to said outlet opening so as to extend substantially radially outwardly, said yarn guide channel guiding a yarn exiting from said outlet opening of said hollow spindle axle radially outwardly for forming a yarn balloon;

a centering element arranged on an axis extending along said hollow spindle axle so as to be spaced from said inlet opening of said hollow spindle axle;

a yarn winding device positioned downstream of said centering element, wherein the yarn is guided from the yarn balloon via said centering element to said yarn winding device;

a means for feeding dissolved fiber material into the space defined by the yarn balloon;

at least two spinning devices positioned within the space defined by the yarn balloon;

each one of said at least two spinning devices having an inlet tube with a receiving opening for receiving the dissolved fiber material;

said means for feeding having a feed tube with a mouth for each one of said at least two spinning devices, said feed tubes positioned outside of said space delimited by the yarn balloon such that said mouths are positioned opposite said receiving openings of said inlet tubes;

each one of said at least two spinning devices having a fiber removal tube arranged such that the fibers generated by said at least two spinning devices are guided centrally into said hollow spindle axle; and a yarn guiding member, for guiding the yarn exiting from said yarn guide channel, fixedly connected to said spindle rotor.

14. A device according to claim 13, wherein said yarn guiding member comprises a yarn guide extending into a gap formed between said mouths of said feed tubes and said receiving openings of said inlet tubes.

15. A device according to claim 14, wherein said chamber comprises a detachable lid.

16. A device according to claim 15, wherein said housing has a detachable cover.

17. A device according to claim 13, wherein said spindle rotor comprises a hollow shaft with a first and a second end, said first end connected to a vacuum line, said device further comprising a substantially closed chamber supported on said hollow shaft and secured against rotation, said at least two spinning devices having a common drive mechanism, said chamber enclosing said at least two spinning devices and said drive mechanism, said chamber having a wall section through which said inlet tubes are guided, said chamber further comprising vacuum channels connected to said second end of said hollow shaft positioned within said chamber and arranged such that via said vacuum line a negative pressure gradient is created in said inlet tubes in a direction of feeding of the dissolved fiber material so as to effect feeding of the dissolved fiber material.

18. A device according to claim 17, further comprising a stationary, substantially closed housing enclosing said chamber, wherein said centering element is provided at a top side of said housing and is in the form of an opening coaxially arranged relative to said hollow spindle axle, and wherein said housing has a sidewall and said mouths of said feed tubes are arranged in said sidewall.

* * * * *